United States Patent [19]

Allen

[11] 4,066,842

[45] Jan. 3, 1978

[54] METHOD AND APPARATUS FOR CANCELLING ROOM REVERBERATION AND NOISE PICKUP

[75] Inventor: Jont Brandon Allen, Westfield, N.J.

[73] Assignee: Bell Telephone Laboratories, Incorporated, Murray Hill, N.J.

[21] Appl. No.: 791,418

[22] Filed: Apr. 27, 1977

[51] Int. Cl.[2] ..... G10L 1/00; H04R 3/00

[52] U.S. Cl. ..... 179/1 P; 179/1 SA

[58] Field of Search ..... 179/1 SA, 1 P

[56] References Cited

U.S. PATENT DOCUMENTS

| | | | |
|---|---|---|---|
| 3,440,350 | 4/1969 | Flanagan | 179/1 SA |
| 3,644,674 | 2/1972 | Mitchell et al. | 179/1 P |
| 3,662,108 | 5/1972 | Flanagan | 179/1 SA |
| 3,794,766 | 2/1974 | Cox | 179/1 P |

*Primary Examiner*—Kathleen H. Claffy

*Assistant Examiner*—E. S. Kemeny

*Attorney, Agent, or Firm*—Henry T. Brendzel

[57] ABSTRACT

Room reverberation and other uncorrelated signal sources characteristic of monaural systems are removed, in accordance with the principles of this invention, by employing two microphones at the sound source and by manipulating the signals of the two microphones to develop a single nonreverberant signal. Both early echoes and late echoes in the signal received by each microphone are removed by manipulating the signals of the two microphones in the frequency domain. Corresponding frequency samples of the two signals are co-phased and added and the magnitude of each resulting frequency sample is modified in accordance with the computed cross-correlation between the corresponding frequency samples. The modified frequency samples are combined and transformed to form the nonreverberant or correlated signal portion.

47 Claims, 3 Drawing Figures

METHOD AND APPARATUS FOR CANCELLING ROOM REVERBERATION AND NOISE PICKUP

BACKGROUND OF THE INVENTION

1. Field of the Invention

This invention relates to signal processing systems and, more particularly, to systems for reducing room reverberation and noise effects in audio systems such as those employed in "hands free telephony."

2. Description of the Prior Art

It is well known that room reverberation can significantly reduce the perceived quality of sounds transmitted by a monaural microphone to a monaural loudspeaker. This quality reduction is particularly disturbing in conference telephony where the nature of the room used is not generally well controlled and where, therefore, room reverberation is a factor.

Room reverberations have been heuristically separated into two categories: early echoes, which are perceived as spectral distortion and their effect is known as "coloration," and longer term reverberations, also known as late reflections or late echoes, which contribute time-domain noise-like perceptions to speech signals. An excellent discussion of room reverberation principles and of the methods used in the art to reduce the effects of such reverberation is presented in "Seeking the Ideal in 'Handsfree' Telephony," Berkley et al, Bell Labs Record, November 1974, page 318, et seq. Therein, the distinction between early echo distortion and late reflection distortion is discussed, together with some of the methods used for removing the different types of distortion. Some of the methods described in this article, and other methods which are pertinent to this disclosure, are organized and discussed below in accordance with the principles employed.

In U.S. Pat. No. 3,786,188, issued Jan. 15, 1974, I described a system for synthesizing speech from a reverberant signal. In that system, the vocal tract transfer function of the speaker is continuously approximated from the reverberant signal, developing thereby a reverberant excitation function. The reverberant excitation function is analyzed to determine certain of the speaker's parameters (such as whether the speaker's function is voiced or unvoiced), and a nonreverberant speech signal is synthesized from the derived parameters. This synthesis approach necessarily makes approximations in the derived parameters, and those approximations, coupled with the small number of parameters, cause some fidelity to be lost.

In "Signal Processing to Reduce Multipath Distortion in Small Rooms," *The Journal of the Acoustics Society of America,* Vol. 47, No. 6, (Part I), 1970, pages 1475 et seq, J. L. Flanagan et al describe a system for reducing early echo effects by combining the signals from two or more microphones to produce a single output signal. In accordance with the described system, the output signal of each microphone is filtered through a number of bandpass signals occupying contiguous frequency ranges, and the microphone receiving greatest average power in a given frequency band is selected to contribute that signal band to the output. The term "contiguous bands" as used in the art and in the context of this disclosure refers to nonoverlapping bands. This method is effective only for reducing early echoes.

In U.S. Pat. No. 3,794,766, issued Feb. 26, 1974, Cox et al describe a system employing a multiplicity of microphones. Signal improvement is realized by equalizing the signal delay in the paths of the various microphones, and the necessary delay for equalization is determined by time-domain correlation techniques. This system operates in the time domain and does not account for different delays at different frequency bands.

In U.S. Pat. No. 3,662,108, issued on May 9, 1972, to J. L. Flanagan, a system employing cepstrum analyzers responsive to a plurality of microphones is described. By summing the output signals of the analyzers, the portions of the cepstrum signals representing the undistorted acoustic signal cohere, while the portions of the cepstrum signals representing the multipath distorted transmitted signals do not. Selective clipping of the summed cepstrum signals eliminates the distortion components, and inverse transformation of the summed and clipped cepstrum signals yields a replica of the original nonreverberant acoustic signal. In this system, again, only early echoes are corrected.

Lastly, in U.S. Pat. No. 3,440,350, issued Apr. 22, 1969, J. L. Flanagan describes a system for reducing the reverberation impairment of signals by employing a plurality of microphones, with each microphone being connected to a phase vocoder. The phase vocoder of each microphone develops a pair of narrow band signals in each of a plurality of contiguous narrow analyzing bands, with one signal representing the magnitude of the short-time Fourier transform, and the other signal representing the phase angle derivative of the short-time Fourier transform. The plurality of phase vocoder signals are averaged to develop composite amplitude and phase signals, and the composite control signals of the plurality of phase vocoders are utilized to synthesize a replica of the nonreverberant acoustic signal. Again, in this system only early echoes are corrected.

In all of the techniques described above, the treatment of early echoes and late echoes is separate, with the bulk of the systems attempting to remove mostly the early echoes. What is needed, then, is a simple approach for removing both early and late echoes.

SUMMARY OF THE INVENTION

Room reverberation and noise characteristics of monaural systems are removed, in accordance with the principles of this invention, by employing two microphones at the sound source and by manipulating the signals of the two microphones to develop a single nonreverberant noise free signal. Both early echoes and late echoes in the signal received by each microphone are removed by manipulating the signals of the two microphones in the frequency domain. Corresponding frequency samples of the two signals are cophased and added and the magnitude of each resulting frequency sample is modified in accordance with the computed cross-correlation between the corresponding frequency samples. The modified frequency samples are combined and transformed to form the desired signal.

DETAILED DESCRIPTION

Figure 1:
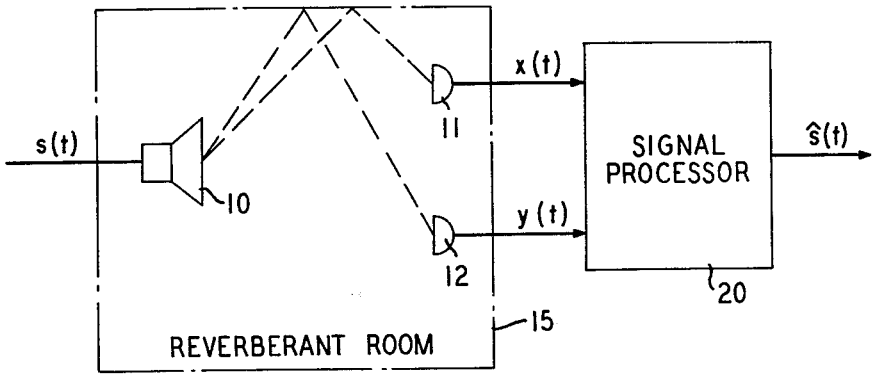
FIG. 1 depicts a reverberant room with a sound source and two receiving microphones.

FIG. 1 shows a sound source 10 in a reverberant room 15 having two somewhat separated microphones 11 and 12. The sounds reaching the two microphones are different from one another because the microphones' distances to the sound source and to the various reflectors in the room are different. Viewed differently, the microphone output signals $x(t)$ and $y(t)$ differ from the source signal and from each other because the different paths operate as a filter applied to the sound. Mathematically, signals $x(t)$ and $y(t)$ may be expressed by $$x(t) = h_1(t) * s(t) \tag{1}$$

and $$y(t) = h_2(t) * s(t) \tag{2}$$

where $s(t)$ is the signal of sound source 10, the symbol "*" indicates the convolution operation, $h_1(t)$ is the impulse response of the signal path between source 10 and microphone 11, and $h_2(t)$ is the impulse response of the signal path between source 10 and microphone 12.

Although the functions $x(t)$ and $y(t)$ differ from room to room, it has been observed that the impulse response $h(t)$ may be divided into an "early echo" section, $e(t)$, and a "late echo" section, $l(t)$. These "early echo" and "late echo" sections are indeed perceivable, but a precise mathematical delineation of where one ends and the other begins has not as yet been discovered. It was observed, however, that the early echo section corresponds to signals which are well correlated, while the late echo section corresponds to signals which are fairly uncorrelated. By being "well correlated" it is meant that the signals $x(t)$ and $y(t)$ have a generally similar waveform but that one waveform is shifted in time with respect to the other waveform. Consequently, when signals are well correlated, the magnitude of the cross correlation function, $r_{xy}(\tau)$, is well above zero from some value of $\tau$.

This invention operates on the $x(t)$ and $y(t)$ signals by separating the signals into frequency bands and by dealing with each corresponding signal band pair independently. Those bands are so narrow that, in effect, this invention operates on the $x(t)$ and $y(t)$ signals in the frequency domain. Early and late echo signals are separated by employing the above described fundamental cross-correlation difference between the echo signals, and reverberations are removed by equalizing the early echo signals through a co-phase and add operation and by attenuating the late echo signals.

The following analysis shows how the different portions of $h(t)$ contribute to the signal's spectrum and how appropriate operations in the frequency domain may be employed to reduce the effect of late echoes.

Applying a Fourier transformation to the signals $x(t)$ and $y(t)$ results in $$X(\omega) = [E_1(\omega) + L_1(\omega)]\, S(\omega) \tag{3}$$

and $$Y(\omega) = [E_2(\omega) + L_2(\omega)]\, S(\omega), \tag{4}$$

where $E_1(\omega)$ and $L_i(\omega)$ are the transforms of $e_i(t)$ and $l_i(t)$, respectively. Equations (3) and (4) may be rewritten as $$X(\omega)/S(\omega) = |E_1(\omega)|\exp(i\theta_1(\omega)) + L_1(\omega) \tag{5}$$

and $$Y(\omega)/S(\omega) = |E_2(\omega)|\exp(i\theta_2(\omega)) + L_2(\omega), \tag{6}$$

where $\theta_1(\omega)$ and $\theta_2(\omega)$ are the phase angle spectra associated with the early echoes. The symbols $|\ |$ call for the magnitude of the complex expression within the symbols.

Applying an all-pass function of the form $\exp(i\theta_2(\omega) - i\theta_1(\omega))$ to signal $X(\omega)$ and adding the result to signal $Y(\omega)$, yields the co-phased and added signal $$U(\omega) = S(\omega)[(|E_1(\omega)| + |E_2(\omega)|\exp(i\theta_2(\omega) + L_1(\omega)\exp(i\theta_2(\omega) - i\theta_1(\omega)) + L_2]. \tag{7}$$

From equation 7 it may be seen that the early echoes add in phase, whereas the late echoes add randomly, depending on the phase angles of $L_1(\omega)$, $L_2(\omega)$ and angle $\theta_2(\omega) - \theta_1(\omega)$. This, of course, effectively attenuates the late echoes as compared to the early echoes and reduces the early echo variation relative to the mean by 3 dB.

Late echoes are attenuated still further by passing the signal $U(\omega)$ through a gain stage, $G(\omega)$, where uncorrelated signals are attenuated. In the gain stage, a function relating to late echoes, such as the cross-correlation function controls the gain in frequency bands.

Thus, in accordance with the principles of this invention, room reverberation and other uncorrelated signals are reduced by applying the equation $$\hat{S}(\omega) = ]Y(\omega) + A(\omega)X(\omega)]G(\omega) \tag{8}$$

to spectra $X(\omega)$ and $Y(\omega)$, where $A(\omega)$ is the all-pass function and $G(\omega)$ is the gain function. Both of these functions are more explicitly defined hereinafter.

In the above analysis there is implied a hidden parameter. That parameter is time.

The transforms $X(\omega)$ and $Y(\omega)$ of equations (3) and (4) are not useful except as representations of the spectra in signals $x(t)$ and $y(t)$ at certain time intervals. Therefore, one should consider the transform not of the functions themselves but of the functions $x(t)$ and $y(t)$ multiplied by a window function $w(t)$ which is zero everywhere except within some defined interval. That window, when chosen to act as a low-pass filter, limits the frequency interval occupied by the transform of the signals, which permits sampling in both the time and frequency domains. One such window which is useful in connection with this invention is the Hamming window, which is defined as $$w(nD) = 0.54 + 0.46\cos(2\pi nD/L) \text{ for } -L/2 \leqq n \leqq L/2 = 0 \text{ elsewhere.} \tag{9}$$

The value of L is dependent on the spacing between microphones 11 and 12. Employing the above window, the transform of the signal $x(t)$ sampled at intervals D seconds is $$X(mF) = \sum_{n=0}^{N-1} x(nD)\, w(nD) e^{inmDF}, \tag{10}$$

where F is the frequency sample spacing given by $2\pi/DN$ and $i$ has the normal connotation. To select a different sequence in the sampled signal $x(n\mathrm{D})$, such as a sequence shifted by $k$T seconds from the previous sequence, only the window $w(n\mathrm{D})$ needs to be shifted by $k$T seconds. The spectrum signal X($m$F), keyed to the shifted window, may be defined by $$X(mF,kT) = \sum_{n=0}^{N-1} w(nD - kT)x(nD)\, e^{inmDF} \tag{11}$$

or $$X(mF,kT) = \underline{F}[w(nD - kT)x(nD)], \tag{12}$$

where $F[\,]$ means the Discrete Fourier transform of the expression within the square brackets.

As indicated previously, the function A($\omega$) or A($m$F,$k$T) must have an all-pass character and must relate to the phase difference of the correlated portions in the windowed signals $x(t)$ and $y(t)$. Thus, A($m$F, $k$T) must relate to the angle of the cross-correlation function of the windowed signals as transformed to the frequency domain, and may alternatively but equivalently be defined as follows:

$$\begin{aligned} A(mF,kT) &= \exp i\{\angle \underline{F}[r_{xy}(nD)]\} \\ &= \exp i[\angle R_{xy}(mF,kT)] \\ &= \frac{F[r_{xy}(nD)]}{|\underline{F}[r_{xy}(nD)]|} \\ &= \frac{R_{xy}(mF,kT)}{|R_{xy}(mF,kT)|} \\ &= \frac{X^*(mF,kT)\,Y(mF,kT)}{|X(mF,kT)|\,|Y(mF,kT)|} \end{aligned} \tag{13}$$

The term $r_{xy}(t)$, in the context of this disclosure, is the cross correlation function of the windowed signals $x(t)$ and $y(t)$. Correspondingly, $R_{xy}(\omega)$ is the transform of $r_{xy}(t)$ or the cross-spectrum of the windowed signals $x(t)$ and $y(t)$. Thus, $R_{xy}$($m$F, $k$T) is equal to X*($m$F,$k$T), where X*($m$F,$k$T) is the complex conjugate of X($m$F,$k$T).

The function G($m$F,$k$T) may be directly proportional to the cross-spectrum function. It should be independent of the absolute power contained in signals $x(t)$ and $y(t)$ and it should be smoothed to obtain an average of the cross-spectrum of the windowed $x(t)$ and $y(t)$ signals. Thus, the function G($m$F,$k$T) may conveniently be defined as $$G(mF,kT) = \frac{\overline{|R_{xy}(mF,kT)|}}{\overline{R_{xx}(mF,kT)} + \overline{R_{yy}(mF,kT)}} \tag{14}$$

or equivalently expressable as $$G(mF,kT) = \frac{\overline{|X^*(mF,kT)\,Y(mF,kT)|}}{\overline{|X(mF,kT)|^2} + \overline{|Y(mF,kT)|^2}} \tag{15}$$

where the bar indicates a running average which may take, for example, the form $$\overline{R_{xy}(mF,kT)} = \alpha\, \overline{R_{xy}(mF,(k-1)T)} + R_{xy}(mF,kT) \tag{16}$$

where $\alpha$ is less than one. The function G($m$F,$k$T), of course, may take on alternative form, as long as it remains a function of the average cross-correlation function.

A perusal of equation 14 reveals that the G($m$F,$k$T) function is indeed real and is proportional to the cross-correlation function. When the signals $x(t)$ and $y(t)$ are well correlated, the magnitude of $\overline{R_{xy}}$ is equal to $\overline{R_{xx}}$ and $\overline{R_{yy}}$, and G($m$F,$k$T) assumes the value ½. When $x(t)$ and $y(t)$ are not correlated, $R_{xy}$ has random phase. As a result the average, $\overline{R_{xy}}$ is close to zero and, consequently, G($m$F,$k$T) is close to zero.

Figure 2:
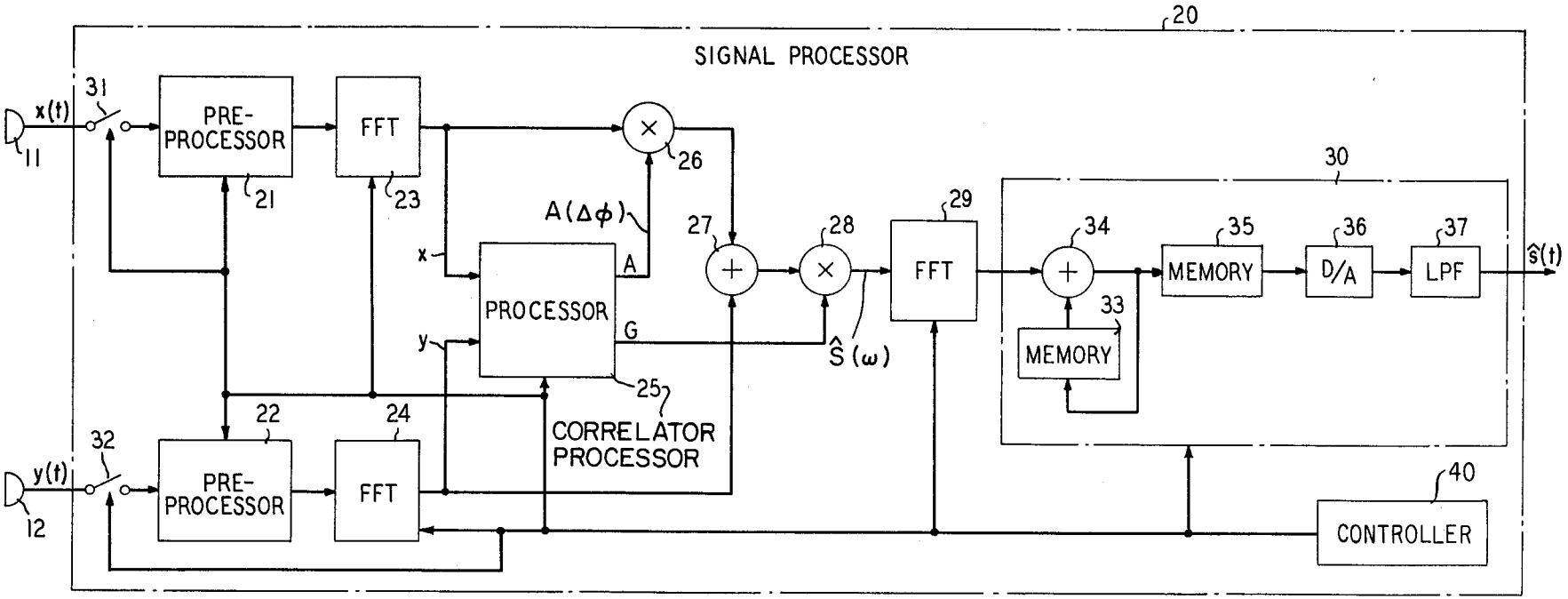
FIG. 2 illustrates one embodiment of apparatus employing the principles of this invention.

FIG. 2 depicts the general block diagram of signal processor 20 in the reverberation reduction system of FIG. 1 which employs the principles of this invention. In FIG. 2, microphones 11 and 12 develop signals $x(t)$ and $y(t)$, respectively. Those signals are sampled and converted into digital form in switches 31 and 32, respectively, developing thereby the sampled sequences $x(n$D) and $y(n$D). To provide for the overlapping windowed sequences $x(n$D)$w(n$D-$k$T), where T < L and L is the width of the window, preprocessors 21 and 22 are respectively connected to switches 31 and 32. Preprocessor 21, which may be of identical construction to processor 22, includes a signal sample memory for storing the latest sequence of L+T samples of $x(n$D), a number of conventional memory addressing counters for transferring signal samples into and out of the memory, and means for multiplying the output signal samples of the signal sample memory by appropriate coefficients of the window function. The coefficients are obtained from a read-only memory addressed by the memory addressing counters. The memory addressing counters subdivide the memory into sections of T locations each. While the memory reads signal samples from addresses $b$ through $b$+L and obtains ROM coefficients from addresses O through L-1, addresses L through L+T are loaded with new data. On the next pass of output developed by processor 21, the signal sample memory is accessed at addresses $b$+T through $b$+T+L. The read and write counters which address the memory operate with the same modulus, which, of course, must be no greater than the size of the signal sample memory.

The above described technique for subdividing a memory and for, in effect, simultaneously reading out of, and writing into, the memory is a well-known technique which, for example, is described by F. W. Thies in U.S. Pat. No. 3,731,284, issued May 1, 1973.

To control the signal processing in processor 20; and more specifically the start instances of the various operations in the processor's component elements, signal processor 20 includes a controller 40 which controls samplers 31 and 32, initializes the various counters in preprocessors 21 and 22, and initializes the processing in elements 23, 24, 25, 29, and 30, all of which are described in more detail hereinafter.

The output signal sequences of preprocessors 21 and 22 are respectively applied to Fast Fourier Transform (FFT) processors 23 and 24. The output sequences of FFT processors 23 and 24 are applied to processor 25 to develop the phase, or delay, factor A($m$F,$k$T) and the gain factor G($m$F,$k$T).

FFT processors 23 and 24 may be conventional FFT processors and may be constructed as shown, for example, in U.S. Pat. No. 3,267,296, issued November 7, 1972, to P. S. Fuss. The output sequences of processors 23 and 24 are the frequency samples X($m$F,$k$T) and Y($m$F,$k$T), respectively, as defined by equation 12.

A brief discussion on certain properties of the Discrete Fourier Transform (DFT) developed by processors 23 and 24 may be in order at this point. Mathematically, the DFT transforms a set of N complex points in a first domain (such as time) into a corresponding set of N complex points in a second domain (such as frequency). Often, the samples in the first domain have only real parts. When such sample points are transformed, the output samples in the second domain appear in complex conjugate pairs. Thus, N real points in the first domain transform into L/2 significant complex points in the second domain, and in order to get N significant complex points at the output (second domain), the number of input samples (first domain) must be doubled. This may be achieved by doubling the sampling rate or, alternatively, the input samples may be augmented with the appropriate number of samples having zero value.

In accordance with the above discussion, the input sequences applied to FFT processors 23 and 24 are 2L points in length, comprising L/2 zero points followed by L data points and finally followed by L/2 additional zero points.

The output samples of processor 23 are the frequency samples $X(mF,kT)$. These samples are multiplied by the appropriate elements of the multiplicative factor $A(mF,kT)$ in multiplier 26. The multiplicative factor $A(mF,kT)$ is received in multiplier 26 from processor 25. Multiplier 26 is a conventional multiplier, of construction similar to that of the multipliers embedded in the FFT processor.

The output samples of multiplier 26 are added to to the output samples of FFT processor 24 in added 27. The summed output signals of adder 27 are multiplied in adder 28 by the multiplicative factor $G(mF,kT)$ which is also developed in processor 25. The output samples of multiplier 28 represent the spectrum signal $S(\omega)$ of equation 8.

To develop a time signal corresponding to the spectrum signal of multiplier 28, an inverse DFT process must take place. Accordingly, FFT processor 29 (which may be identical in its construction to FFT 23) is connected to multiplier 28 to develop sets of output samples, with each set representing a time segment. Each time segment is shifted from the previous time segment by $k$T samples, just as the time segments to processor 23 and 24 are shifted by $k$T samples.

To develop a single output sequence from the time samples of the different sequences appearing at the output of processor 29, successive sequences may appropriately be averaged or simply added. That is, an output sample $S(nD)$ of one segment may be added to sample $S(nD\text{-}kT)$ of the next segment and to sample $S(nD\text{-}2kT)$ of the following segment, and so forth. This addition, conversion to analog, and the low-pass filtering required to convert a sampled sequence onto a continuous signal, are performed in synthesis block 30 which is connected to FFT processor 29.

Synthesis block 30 includes a memory 33, an adder 34 responsive to processor 29 and to memory 33 for providing input signals to memory 33, a memory 35 of T locations responsive to adder 34, a D/A converter 36 responsive to memory 35, and an analog low-pass filter 37. Memory 33 has L locations and is so arranged that at any instant (as referenced in the equations by $k$T) the previous partial sums reside in the memory. Thus, in any location $u$, resides the sum $$\hat{s}(uD,kT) + \hat{s}(uD+T,(k-1)T) + \hat{s}(uD+2T,(k-2)T)\ldots, \tag{17}$$

which has a number of terms equal to the integer portion of L/T. With each set of output samples out of processor 29, a new set of partial sums is computed and stored in memory 33 by appropriately adding the stored partial sums to the newly arrived samples. Mathematically, this may be expressed by $$\Sigma(uD,(k+1)T) = \Sigma(uD+T,kT) + \hat{s}(uD,(k+1)T) \tag{18}$$

where the sum $\Sigma(uD(k+1)T)$ is the new sum to be stored at location $u$, $\Sigma(uD+T,kT)$ is the old sum found at location $u+T$ and $\hat{s}(uD,(k+1)T)$ is the newly arrived sample $\hat{s}(uD)$. At each new partial sums computation, the first T computed partial sums are the final sums and are therefore gated and stored in memory 35. Memory 35 appropriately delays the burst of T sums and delivers equally spaced samples to D/A converter 36. The converted analog samples are applied to a low-pass filter 37, developing thereby the desired nonreverberant signal $\hat{s}(t)$.

Figure 3:
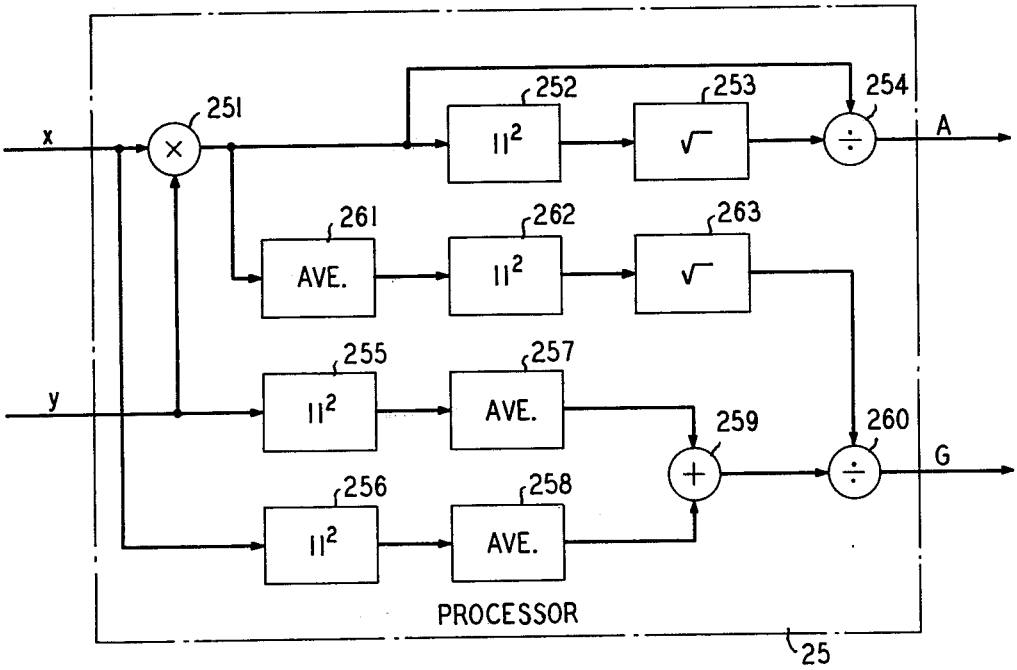
FIG. 3 illustrates a schematic diagram of processor 25 in the apparatus of FIG. 2.

As indicated previously, processor 25 develops the signals $A(mF,kT)$ and $G(mF,kT)$ and may be implemented in a number of ways depending on the form of equations 13 and 14 that are realized. FIG. 3 depicts one block diagram for processor 25, where the factor $A(mF,kT)$ is obtained by evaluating the equation $$A(mF,kT) = X^*(mF,kT)Y(mF,kT)/|X^*(mF,kT)Y(mF,kT)| \tag{19}$$

and where the factor $G(mF,kT)$ is realized by evaluating equation 15.

To develop the signal of equation 19, the spectrum signals $X(mF,kT)$ and $Y(mF,kT)$ are applied to multiplier 251 in FIG. 3, wherein the product signal $X^*(mF,kT)Y(mF,kT)$ is developed. The term $X^*(mF,kT)$ is the complex conjugate of $X(mF,kT)$ and therefore the desired product may be developed in a conventional manner by a cartesian coordinate multiplier which is constructed in much the same manner as are the multipliers within FFT processors 23 and 24. The output signal of multiplier 251 is applied to a magnitude squared circuit 252, which develops the signal $|X^*(mF,kT)Y(mF,kT)|^2$. That output signal is applied to square root circuit 253, and the output signal of circuit 253 is applied to division circuit 254. The output signal of multiplier 251 is also applied to division circuit 254. Circuit 254 is arranged to develop the desired signal, $X^*(mF,kT)Y(mF,kT)/|X^*(mF,kT)Y(mF,kT)|$ as specified by equation 19.

To develop the $G(mF,kT)$ function, the $X(mF,kT)$ and $Y(mF,kT)$ signals applied to processor 25 are connected to magnitude squared circuits 255 and 256, respectively, yielding the signals $|X(mF,kT)|^2$ and $|Y(mF,kT)|^2$. These signals are smoothed in averaging circuits 257 and 258 (which are connected to circuits 255 and 256, respectively), and the averaged signals are summed in adder 259. The output signal of adder 259 corresponds to the term $|\overline{X(mF,kT)}|^2 + |\overline{Y(mF,kT)}|^2$ of equation 15.

The cross-correlation signal $X^*(mF,kT)Y(mF,kT)$ developed by multiplier 251 is averaged in circuit 261, and the magnitude of the developed average is obtained with a magnitude circuit which comprises magnitude squared circuit 262 connected to the output of circuit 261 and a square root circuit 263 connected to the output of circuit 262. The output signal of circuit 263 corresponds to the term $|\overline{X^*(mF,kT)Y(mF,kT)}|$ of equation 15.

To finally obtain the $G(mF,kT)$ term, the output signals of circuits 263 and 259 are connected to division circuit 260 and are arranged to develop the desired quotient signal of equation 15.

Magnitude squared circuits 252, 255, 256 and 262 may be of identical construction and may simply comprise a multiplier, identical to multiplier 251, for evaluating the product signals $P(mF,kT)P^*(mF,kT)$ where $P(mF,kT)$ represents the particular input signal of the multiplier.

Square root circuits 253 and 263 are, most conveniently, implemented with a read only memory look-up table. Alternately, a D/A and an A/D converter pair may be employed together with an analog square root circuit. One such circuit is described in U.S. Pat. No. 3,987,366 issued to Redman on Oct. 19, 1976. Alternatively yet, various square root approximation techniques may be employed.

Division circuits 254 and 260 are also most conveniently implemented with a read only memory look-up table. In such an implementation, the address to the memory is the divisor and the divident signals concatenated to form a single address field, and the memory output is the desired quotient. Such a division circuit has been successfully employed in the apparatus described by H. T. Brendzel in U.S. Pat. No. 3,855,423, issued Dec. 17, 1974.

Lastly, averaging circuits 257, 258, and 256, which realize equation 16, are most conveniently implemented by storing the running average in an accumulator, by adding the fraction $\alpha$ of the accumulated content to the current input signal, thereby forming a new running average, and by storing the developed new average in the accumulator. Such averages are well known in the art and are described, for example, by P. Hirsch in U.S. Pat. Nos. 3,717,812, issued Feb. 20, 1973, and 3,821,482, issued June 28, 1974.

What is claimed is:

1. A method for generating nonreverberant and noise free sound signals adapted for monaural operation comprising the steps of:

receiving the signals of a first signal pick-up device and of a second signal pick-up device which is spatially separated from said first signal pick-up device;

separating the signals of said first and second pick-up devices into a plurality of frequency band signals;

multiplying each frequency band signal of said first pick-up device by a unity magnitude phasor having a phase angle equal to the phase angle difference between each frequency band signal of said first pick-up device and a corresponding frequency band signal of said second pick-up device;

adding to each of said multiplied frequency band signals of said first pick-up device and corresponding frequency band signals of said second pick-up device to form a plurality of combined frequency band signals;

multiplying each of said combined frequency band signals by a gain factor related to the cross correlation between the frequency band signals forming each of said combined frequency band signals, to form gain factor multiplied frequency band signals; and combining the gain factor multiplied frequency band signals of said step of multiplying each of said combined frequency band signals to form a single nonreverberant and noise free signal.

2. A method of generating nonreverberant sound signals adapted for monaural operation comprising the steps of:

receiving a signal $x(t)$ of a first microphone and a signal $y(t)$ of a second microphone which is spatially separated from said first microphone;

converting said $x(t)$ signal to a frequency domain signal $X(\omega)$ and said $y(t)$ signal to a frequency domain signal $Y(\omega)$;

multiplying said frequency domain signal $X(\omega)$ by a unity magnitude phasor $A(\omega)$ having a phase angle at each frequency $\omega$ equal to the phase angle difference at said frequency $\omega$ between said $X(\omega)$ and $Y(\omega)$ signals to form a product signal $A(\omega)X(\omega)$;

adding to each frequency element of said $Y(\omega)$ signal corresponding frequency elements of said $A(\omega)X(\omega)$ signal to form a co-phased and added signal;

multiplying said co-phased and added signal by a gain factor related to the cross-spectrum function $R_{xy}(\omega)$ of the component signals $X(\omega)$ and $Y(\omega)$ to form a gain factor multiplied signal; and converting said gain factor multiplied signal to form a single nonreverberant time domain signal.

3. A method for generating nonreverberant sound signals from a sound source located in a reverberant room comprising the steps of:

receiving a signal $x(t)$ of a first microphone and a signal $y(t)$ of a second microphone which is spatially separated from said first microphone;

sampling said $x(t)$ and $y(t)$ signals at D second intervals to form sampled signals $x(nD)$ and $y(nD)$, where $n$ is a running variable;

forming short-term Fourier spectra signals $X(mF)$ and $Y(mF)$ of signals $x(nD)$ and $y(nD)$, respectively, where F is a frequency spacing and m is a running variable;

multiplying said $X(mF)$ spectrum signal by a phasor signal $A(mF)$ having a phase angle at each frequency element $mF$ equal to the phase angle difference between $X(mF)$ and $Y(mF)$ signals, forming thereby a product signal $A(mF)X(mF)$;

adding said $Y(mF)$ signal to said product signal $A(mF)X(mF)$ to form a co-phased and added signal;

multiplying said co-phased and added signal by a gain factor related to the cross-spectrum function of said $X(mF)$ and $Y(mF)$ signals to form a gain factor multiplied signal; and combining said gain factor multiplied signal to form a single nonreverberant time domain signal.

4. The method of claim 3 wherein said factor $A(mF)$ is proportional to a product signal $X^*(mF)Y(mF)$ divided by the magnitude of said $X^*(mF),Y(mF)$ product signal, where the component signal $X^*(mF)$ is the complex conjugate of said $X(mF)$ signal.

5. The method of claim 3 wherein said step of sampling includes a step of low-pass filtering of said $x(t)$ and $y(t)$ signals.

6. The method of claim 3 wherein said step of forming short-term Fourier spectra includes a step of low-pass filtering of said sampled signals $x(nD)$ and $y(nD)$.

7. The method of claim 6 wherein said low-pass filtering of said sampled signals comprises a Hamming window function.

8. A method for generating a nonreverberant signal in response to sounds generated in a reverberant room comprising the steps of:

receiving a signal $x(t)$ from a first microphone located in said reverberant room and a signal $y(t)$ from a second microphone located in said reverberant room, said second microphone being spatially separated from said first microphone;

low-pass filtering of said $x(t)$ and $y(t)$ received signals;

sampling at D second intervals said $x(t)$ and $y(t)$ signals to form signal sequences $x(n\mathrm{D})$ and $y(n\mathrm{D})$;

low-pass filtering said $x(n\mathrm{D})$ and $y(n\mathrm{D})$ sampled signals;

transforming to frequency domain successive fixed length subsequences of said $x(n\mathrm{D})$ and $y(n\mathrm{D})$ sequences;

multiplying the transformed signal of said $x(n\mathrm{D})$ sequence by a unity magnitude phasor whose angle is proportional to the cross-spectrum function of said transformed signals;

adding the transformed signal of said $y(n\mathrm{D})$ sequence to the phasor multiplied signal of said step of multiplying the transformed signal of said $x(n\mathrm{D})$ sequence;

multiplying the output signal developed by said step of adding with a gain control factor proportional to the normalized average magnitude of said cross-spectrum function; and transforming to time domain the signals developed by said step of multiplying with a gain factor.

9. The method of claim 8 wherein said unity magnitude phasor is proportional to a frequency domain transform of the cross correlation function of said fixed length subsequences of said $x(n\mathrm{D})$ and $y(n\mathrm{D})$ sequences.

10. The method of claim 8 wherein said gain control factor is proportional to an averaged magnitude of said cross spectrum function divided by the sum of the power in said $x(n\mathrm{D})$ and $y(n\mathrm{D})$ subsequences.

11. The method of claim 8 wherein each of said steps of transforming is a step of Discrete Fourier Transform computation.

12. The method of claim 11 wherein said steps of Discrete Fourier Transform computation employ the Fast Fourier Transform algorithm.

13. The method of claim 8 wherein said successive fixed length subsequences overlap.

14. The method of claim 13 wherein said step of transforming to time domain further comprises the steps of:

adding corresponding time sample members of consecutively transformed time domain subsequences;

converting the added time sample members of said step of adding to form an analog signal; and low-pass filtering said analog signal.

15. A reverberation reduction apparatus responsive to a first signal developed by a first signal pick-up device and a second signal developed by a second signal pick-up device comprising:

an all-pass filter for imparting a phase angle to said first signal in accordance with a delay control signal;

first processor means responsive to said first and second signals for developing said delay control signal in proportion to the angle of the cross-spectrum of said first and second signals;

adder means for combining said second signal with the output signal of said all-pass filter;

second processor means responsive to said first and second signals for developing a gain control signal proportional to an averaged magnitude of the cross-spectrum of said first and second signals; and gain control means for modifying the output signal of said adder means in response to said gain control signal.

16. The apparatus of claim 15 further comprising means responsive to said gain control means for developing a single nonreverberant time signal.

17. Apparatus for developing a nonreverberant noise free signal in response to sounds developed in a room capable of sustaining uncorrelated signals comprising:

a first signal pick-up means;

a second signal pick-up means in spatial proximity to said first signal pick-up means;

means for subdividing the signal generated by said first pick-up means into narrow frequency bands;

means for subdividing the signal generated by said second pick-up means into narrow frequency bands corresponding to said narrow frequency bands of said first pick-up means;

means for combining said corresponding narrow frequency bands of said first and second pick-up means under control of a delay determining signal, to form combined narrow frequency bands;

means for modifying the amplitude of said combined narrow frequency bands under control with a gain determining signal; and processor means responsive to said narrow frequency bands of said first pick-up means and to said narrow frequency bands of said second pick-up means for developing said delay determining signal and said gain determining signal.

18. The apparatus of claim 17 wherein said delay determining signal is a phasor having a unity magnitude and a phase angle proportional to the phase angle difference between said signal generated by said first pick-up means and said signal generated by said second pick-up means.

19. The apparatus of claim 17 wherein said delay determining signal is a phasor signal subdivided into narrow frequency phase bands corresponding to said narrow frequency bands with said first pick-up means, with each of said phase bands having unity magnitude and a phase angle proportional to the phase angle difference between each corresponding narrow frequency band of said first pick-up means and corresponding narrow frequency band of said second pick-up means.

20. The apparatus of claim 17 wherein said gain determining signal is subdivided into narrow frequency gain bands corresponding to said narrow frequency bands of said first pick-up means and each of said gani bands is proportional to the averaged magnitude of the frequency domain transformed cross-correlation function of corresponding narrow frequency bands of said first and second pick-up means.

21. Apparatus for developing a nonreverberant signal including two microphones and circuitry for performing a co-phase and add operation on the output signals of said two microphones, the improvement comprising:

a processor connected to said circuitry for performing said co-phase and add operation for modifying the output signal of said circuitry in accordance with a gain control signal proportional to the averaged magnitude of the cross-spectrum function of said output signals developed by said two microphones.

22. The apparatus of claim 21 further comprising synthesis means for converting the output signal of said processor into a single nonreverberant time signal.

23. Apparatus for developing a nonreverberant signal including a first microphone and a second microphone, both situated in a reverberant room and in proximity to one another comprising:

first means for sampling the output signals of said first microphone and said second microphone to develop sampled signals $x(nD)$ and $y(nD)$, respectively;

second means for transforming successive and overlapping fixed length sequences of said $x(nD)$ and $y(nD)$ signals into the frequency domain to form signals $X(mF,kT)$ and $Y(mF,kT)$, respectively;

third means for combining said $X(mF,kT)$ and $Y(mF,kT)$ signals to form co-phased and added signals;

fourth means for modifying the gain of said co-phased and added signals to form a gain modified signal; and fifth means for transforming said gain modified signal to a nonreverberant time sample sequence.

24. The apparatus of claim 23 further comprising D/A converter means responsive to said fifth means.

25. The apparatus of claim 23 wherein said first means further comprises low-pass filter means.

26. The apparatus of claim 23 wherein said $X(mF,kT)$ and $Y(mF,kT)$ signals are combined in said third means under control of a delay determining signal $A(mF,kT)$.

27. The apparatus of claim 26 wherein said third means develops the function $Y(mF,kT) + A(mF,kT)X(mF,kT)$.

28. The apparatus of claim 27 wherein said fourth means modifies the gain of said co-phased and added signals under control of a gain determining signal to form said gain modified signal in accordance with the equation $[Y(mF,kT) + A(mF,kT)X(mF,kT)]G(mF,kT)$.

29. The apparatus of claim 28 further comprising sixth means responsive to said second means for developing said delay determining signal $A(mF,kT)$ and said gain determining signal $G(mF,kT)$.

30. The apparatus of claim 23 wherein said overlapping of said sequences is greater than zero and less than said length of said fixed length sequences which are transformed in said second means.

31. The apparatus of claim 30 wherein said delay determining factor $A(mF,kT)$ is a phasor alternatively expressable by $\exp i\{\angle F[r_{xy}(nD)]\}$ or $\exp i\ [\angle R_{xy}(mF,kT)]$, where $F$ is the Fourier transform, $r_{xy}$ is the cross-correlation function, and $R_{xy}$ is the cross-spectrum function.

32. The apparatus of claim 30 wherein said delay determining factor $A(mF,kT)$ is a phasor expressable by $R_{xy}(mF,kT)/|R_{xy}(mF,kT)|$, where $R_{xy}$ is the cross-spectrum function.

33. The apparatus of claim 30 wherein said delay determining factor $A(mF,kT)$ is a phasor expressable by $X^*(mF,kT)Y(mF,kT)/|X(mF,kT)|\,|Y(mF,kT)|$.

34. The apparatus of claim 23 wherein said gain determining signal $G(mF,kT)$ is expressable by $|\overline{R_{xy}(mF,kT)}|/[\overline{R_{xx}(mF,kT)} + \overline{R_{yy}(mF,kT)}]$.

35. The apparatus of claim 23 wherein said gain determining signal $G(mF,kT)$ is expressable by $|\overline{X^*(mF,kT)Y(mF,kT)}|/[|\overline{X(mF,kT)}|^2 + |\overline{Y(mF,kT)}|^2]$.

36. Apparatus for developing a nonreverberant signal in response to sounds produced in a reverberant room, including a first sound pick-up device developing a first input signal and a second sound pick-up device developing a second input signal comprising:

first processor means for developing sample sequences of successive and overlapping fixed length segments of said first input signal;

second processor means for developing frequency sample sequences of successive and overlapping fixed length segments of said second input signal which correspond to said successive and overlapping fixed length segments of said first input signal;

third processor means for combining said frequency sample sequences of said first and second processor means; and fourth processor means responsive to said third processor means for developing said nonreverberant signal.

37. The apparatus of claim 36 wherein said first processor comprises:

sixth means for sampling said first input signal to form a sequence of time sample signals;

seventh means responsive to said first means for developing overlapping fixed length subsequences of said sequence of time sample signals; and eighth means for developing a Discrete Fourier Transform of said subsequences developed by said second means.

38. The apparatus of claim 37 wherein said eighth means for developing Discrete Fourier Transform is an FFT processor.

39. The apparatus of claim 37 wherein said seventh means further comprises ninth means for low-pass filtering said subsequences.

40. The apparatus of claim 39 wherein said ninth means realizes a Hamming window.

41. The apparatus of claim 36, further comprising a fifth processor means for developing control signals to affect the combining within said third processor.

42. The apparatus of claim 41 wherein said fifth processor means develops a delay control signal A and a gain control signal G.

43. The apparatus of claim 42 wherein said third processor means develops an output signal in accordance with the equation $(Y + AX)G$, where X is the output signal of said first processor means and Y is the output signal of said second processor means.

44. The apparatus of claim 36 wherein said fourth processor means comprises:

means for developing the Discrete Fourier Transform of the output signal of said third processor means, thereby developing overlapping fixed length time sample subsequences; and means for combining said overlapping fixed length time sample subsequences to form a single nonreverberant signal.

45. A method for generating nonreverberant sound signals adapted for monaural operation comprising the steps of:

receiving the signals of a first signal pick-up device and of a second signal pick-up device which is spatially separated from said first signal pick-up device;

separating the signals of said first and second pick-up devices into a plurality of frequency band signals;

multiplying each frequency band signal of said first pick-up device by a unity magnitude phasor having a phase angle equal to the phase angle difference between each frequency band signal of said first pick-up device and a corresponding frequency band signal of said second pick-up device;

adding to each of said multiplied frequency band signals of said first pick-up device said corresponding frequency band signals of said second pick-up device to form a plurality of combined frequency band signals;

multiplying each of said combined frequency band signals by a gain factor related to the late echo affects in the frequency band signals forming each of said combined frequency band signals, to form gain factor multiplied frequency band signals; and combining the gain factor multiplied frequency band signals of said step of multiplying each of said combined frequency band signals to form a single nonreverberant signal.

46. A reverberation reduction apparatus responsive to a first signal developed by a first signal pick-up device and a second signal developed by a second signal pick-up device comprising:

an all-pass filter for imparting a phase angle to said first signal in accordance with a delay control signal;

first processor means responsive to said first and second signals for developing said delay control signal in proportion to the angle of the cross-spectrum of said first and second signals;

adder means for combining said second signal with the output signal of said all-pass filter;

second processor means responsive to said first and second signals for developing a gain control signal related to the cross-spectrum of said first and second signals; and gain control means for modifying the output signal of said adder means in response to said gain control signal.

47. Apparatus for developing a nonreverberant signal including two microphones and circuitry for performing a co-phase and add operation on the output signals of said two microphones, the improvement comprising:

a processor connected to said circuitry for performing said co-phase and add operation for modifying the output signal of said circuitry in accordance with a gain control signal related to the cross-spectrum function of said output signals developed by said two microphones.

* * * * *

UNITED STATES PATENT AND TRADEMARK OFFICE

CERTIFICATE OF CORRECTION

PATENT NO. : 4,066,842

DATED : January 3, 1978

INVENTOR(S) : Jont B. Allen

It is certified that error appears in the above-identified patent and that said Letters Patent are hereby corrected as shown below:

Column 3, line 63, "$E_1$" should read --$E_i$--. Column 5, line 35, the equation reading X*(mF,kT) should read X*(mF,kT)Y(mF,kT).

Column 7, line 30, "S" should read --$\hat{S}$--. Column 9, line 52, "and" should read --said--. Claim 45, column 15, line 5, "affects" should read --effects--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*